US006879787B2

(12) United States Patent
Iino

(10) Patent No.: US 6,879,787 B2
(45) Date of Patent: Apr. 12, 2005

(54) IMAGE FORMING APPARATUS WITH SELF-DIAGNOSIS MODE

(75) Inventor: Ayako Iino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/449,116

(22) Filed: Jun. 2, 2003

(65) Prior Publication Data

US 2004/0008999 A1 Jan. 15, 2004

(30) Foreign Application Priority Data

Jun. 12, 2002 (JP) ..... 2002-171421

(51) Int. Cl.[7] ..... G03G 15/08
(52) U.S. Cl. ..... 399/29
(58) Field of Search ..... 399/29, 24, 9, 399/252, 264, 359

(56) References Cited

U.S. PATENT DOCUMENTS 6,366,754 B1 * 4/2002 Sato et al. ..... 399/223
6,721,534 B2 * 4/2004 Takahashi ..... 399/359

FOREIGN PATENT DOCUMENTS

| | | |
|---|---|---|
| JP | 7-209929 | 8/1995 |
| JP | 8-56291 | 2/1996 |
| JP | 8-85236 | 4/1996 |
| JP | 8-194358 | 7/1996 |
| JP | 8-314253 | 11/1996 |
| JP | 9-185209 | 7/1997 |
| JP | 2000-242152 | 9/2000 |

* cited by examiner

*Primary Examiner*—Quana Grainger
(74) *Attorney, Agent, or Firm*—Oblon, Spivak, McClelland, Maier & Neustadt, P.C.

(57) ABSTRACT

Each of a plurality of developing units accommodates toner of different color. Toner images of the different colors are formed on corresponding image carriers and sequentially transferred onto an image transfer medium. Toner remaining on the image carriers is recovered after transfer of toner image of particular color. The toner recovered is supplied to corresponding developing unit for reuse. A controller controls the operation of the image forming apparatus. The controller starts a self-diagnosis mode when receiving an interruption signal. The self-diagnosis mode includes detecting how the toners of different colors are mixed in each developing unit.

18 Claims, 7 Drawing Sheets

IMAGE FORMING APPARATUS WITH SELF-DIAGNOSIS MODE

BACKGROUND OF THE INVENTION

1) Field of the Invention

The present invention relates to an image forming apparatus that forms a color image by using an electrophotographic process.

2) Description of the Related Art

In a color image forming apparatus that uses the electrophotographic process, toner recycling has been strongly demanded from the viewpoint of improving energy saving and maintenance of the apparatus. However, mixing of colors becomes a hindrance in carrying out the toner recycling.

The color image forming apparatus usually forms toner images on image carriers using three colors or four colors. The toner images of the colors formed on the image carriers are then transferred onto an intermediate transfer unit or a transfer material as a transfer medium, thereby to form a full-color image. A cleaning unit is provided for each image carrier corresponding to each color. The cleaning unit recovers toner remaining on the image carrier after transfer (hereinafter, "residual toner"). The toner recovered is recycled.

However, this type of image forming apparatus has the following problem. That is, when a first color toner is transferred onto the intermediate transfer unit and a second color toner is transferred onto the intermediate transfer unit, the first color toner is reversibly transferred onto the image carrier. When this reverse transfer phenomenon occurs, colors of the recovered toners are mixed within the cleaning unit, which makes it difficult to carry out the recycling of the toners.

In the mean time, color reproducibility on the image is regarded most important. The color reproducibility is determined based on various image forming factors such as characteristics of image processing, charging, exposure, developing, transfer, fixing, toners, and a photoreceptor. When the color reproducibility is lost, it is necessary to adjust it. However, it is difficult to simply specify a cause of the loss of the color reproducibility.

Japanese Patent Application Laid-open Publication No. 8-56291 describes a method of "adjusting colors based on a stable image processing and process control of an input image".

However, the change in the color reproducibility is largely influenced by color mixture of recycled toners. The color mixture causes the loss of the total color reproducibility.

Japanese Patent Application Laid-open Publication No. 2000-242152 describes a method of preventing the color mixing. Precisely, the color mixing is prevented by providing a reversibly charged toner removing unit such that the color mixture within each developing unit is effectively prevented by utilizing a difference in charge polarity between a residual toner on the image carrier after the image transfer and a reversibly transferred toner.

However, it is difficult to completely prevent the occurrence of color mixture. When the color mixture of toners within the developing unit exceeds a permissible level, there is no other way than to replace the toners using a certain method.

Japanese Patent Application Laid-open Publication No. 8-314253 describes the following method and apparatus to solve this problem. The apparatus has a controller that controls a recording unit as follows. When a developer is stirred for a long time in a state that toner in a developer container part of the developing unit is not consumed or the developer container part is not replenished with toner, the controller forms a latent image to compulsively consume toner, develops the latent image, adheres the toner onto a photoreceptor drum, and compulsively replenishes the developer container part with toner. Based on this arrangement, the apparatus can suppress degradation of the developer due to stirred friction.

However, according to this method, it is necessary to consume the toner, which requires time and labor, regardless of whether this work is carried out manually or automatically.

SUMMARY OF THE INVENTION

It is an object of the present invention to solve at least the problems in the conventional technology.

According to the present invention, an image forming apparatus includes a plurality of developing units that accommodate toners of different colors, and a plurality of image carriers on which toner images of the different colors are formed. The image forming apparatus also includes a transfer medium onto which the toner images are sequentially transferred from the image carriers, in which toner remaining on each of the image carriers after image transfer is recovered, and the recovered toner is supplied to each of the developing unit for reutilization of the recovered toner. The image forming apparatus further includes a controller that controls operation of the image forming apparatus. The controller starts a self-diagnosis mode based on an interruption signal, and diagnosis is performed on the image forming apparatus in the self-diagnosis mode. The diagnosis includes detecting how colors of toners are mixed within each of the developing units.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention will be explained in detail below with reference to the accompanying drawings.

The image forming apparatus according to the present invention has an operation switch for a self-diagnosis mode ("self-diagnosis mode operation switch") on a liquid-crystal operation panel based on a user's touch on a liquid crystal screen. The operation switch is used to carry out an operation in the self-diagnosis mode ("self-diagnosis mode operation"). The self-diagnosis mode operation switch may be provided as a single unit on the operation panel portion.

The self-diagnosis mode operation switch may be a voice recognizer. When the voice recognizer is used, the user registers an optional word by inputting the word in voice. Thereafter, when the user vocalizes the word, the apparatus starts the self-diagnosis mode operation.

As a structural example of the image forming apparatus according to the present invention, a tandem type color image forming apparatus using an intermediate transfer system (i.e., a color copier or a color printer) will be explained.

Figure 1:
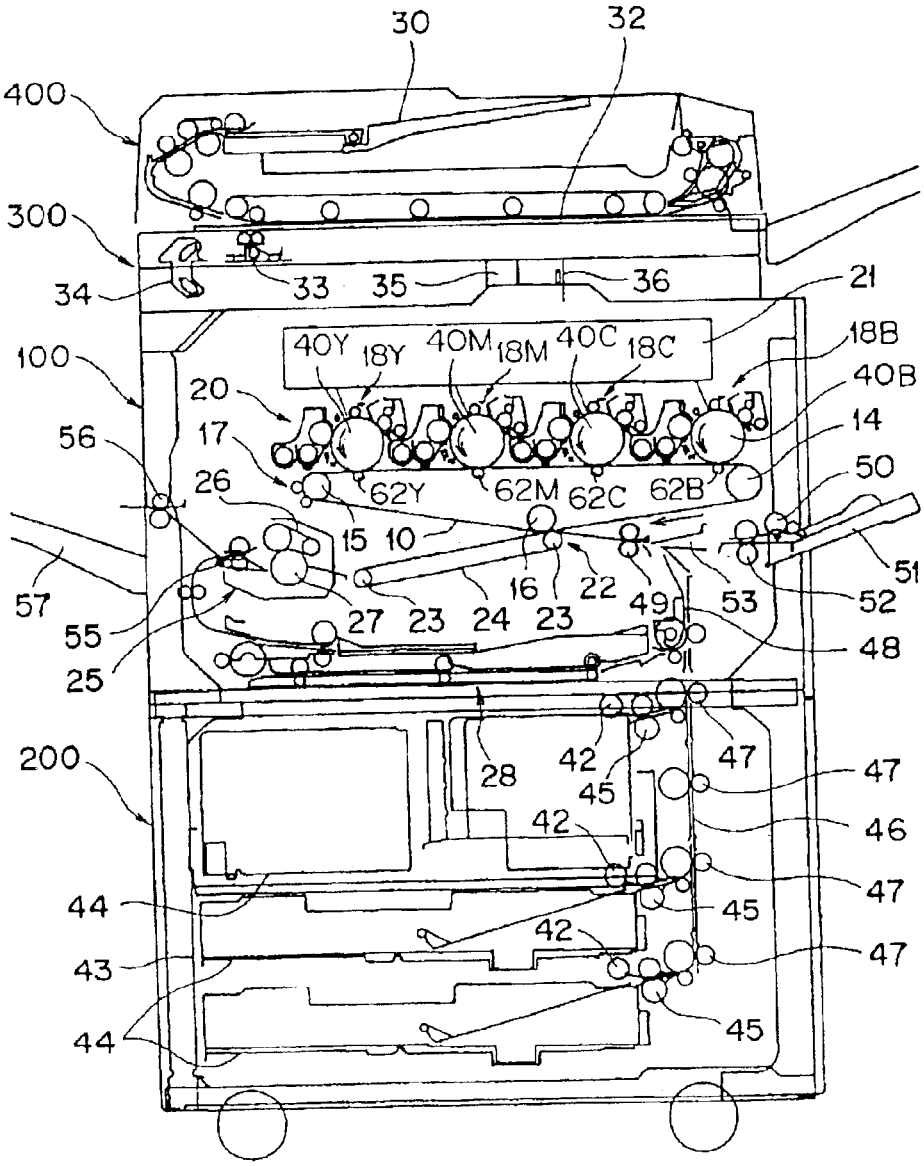
FIG. 1 is a schematic diagram of a color copier as one example of an image forming apparatus according to the present invention.

FIG. 1 is a schematic diagram of a color copier as one example of the image forming apparatus according to the present invention. In FIG. 1, a reference numeral 100 denotes a copier body (i.e., a color printer part), and 200 denotes a paper feeding table on which the copier body 100 is mounted. A reference numeral 300 denotes a document reader (i.e., a scanner) that is fitted on the copier body 100, and 400 denotes an automatic document feeder (ADF) that is fitted on the document reader 300.

The copier body 100 has an intermediate transfer belt 10 provided as a primary transfer medium or as an intermediate transfer unit in the center of the copier body 100. This intermediate transfer belt 10 is wound around among three supporting rollers 14, 15, and 16 to allow the intermediate transfer belt 10 to rotate in a clockwise direction, as shown in FIG. 1. In this example, at the left of the second supporting roller 15 out of the three supporting rollers, a cleaning unit 17 for the intermediate transfer unit ("an intermediate transfer unit cleaning unit 17") is provided. The intermediate transfer unit cleaning unit 17 removes residual toner on the intermediate transfer belt 10 after transferring an image therefrom. Above the intermediate transfer belt 10 stretched around between the first supporting roller 14 and the second supporting roller 15 out of the three supporting rollers, four image forming units 18Y, 18M, 18C, and 18B are disposed laterally in this order along the belt conveying direction. The four image forming units that form four color images of yellow (Y), magenta (M), cyan (C), and black (B) respectively, constitutes a tandem type image forming section 20. The order of the four colors shows one example, and the order is not limited to the above.

Figure 2:
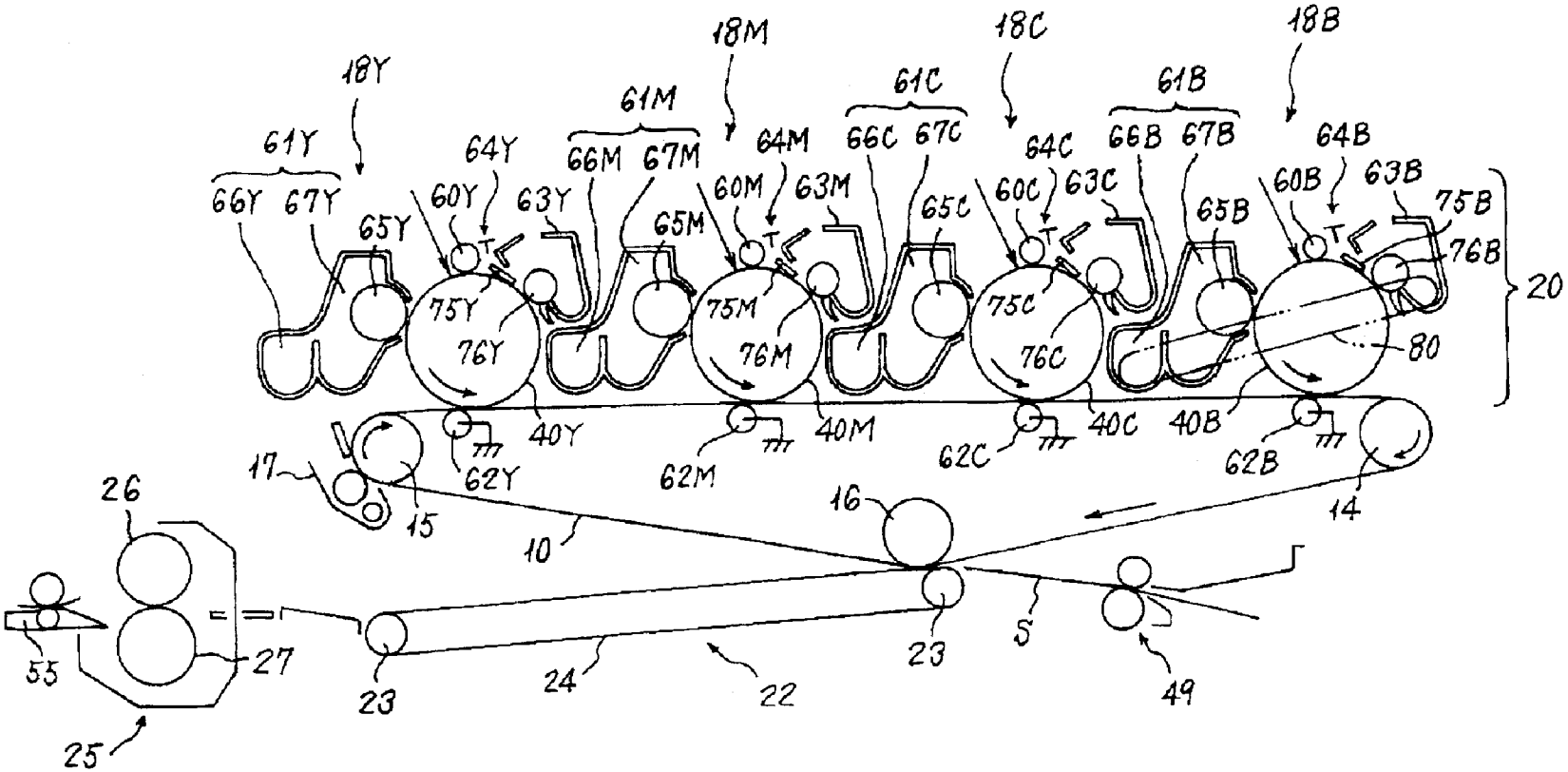
FIG. 2 is a partially enlarged diagram of a tandem type image forming section in the color image forming apparatus shown in FIG. 1.

FIG. 2 is a partially enlarged diagram of the tandem type image forming section 20 in the color image forming apparatus shown in FIG. 1. In the tandem type image forming section 20, the image forming units 18Y, 18M, 18C, and 18B as individual toner image forming units have units as follows provided around photoreceptor drums 40Y, 40M, 40C, and 40B as drum-like image carriers, respectively. The units include charging units 60Y, 60M, 60C, and 60B, developing units 61Y, 61M, 61C, and 61B, primary transfer units (for example, transfer rollers or transfer chargers) 62Y, 62M, 62C, and 62B, photoreceptor cleaning units 63Y, 63M, 63C, and 63B, and decharging units 64Y, 64M, 64C, and 64B.

The charging units 60Y, 60M, 60C, and 60B are charge rollers made of roller charge members in the example shown in the drawings. The charging units apply voltages to the photoreceptor drums 40Y, 40M, 40C, and 40B in contact with these photoreceptor drums respectively, thereby to charge the photoreceptor drums 40Y, 40M, 40C, and 40B. Instead of the charge rollers, it is of course possible to use charge brushes. It is also possible to charge the photoreceptor drums 40Y, 40M, 40C, and 40B with a non-contact Scorotoron charger or the like.

An exposing unit 21 is provided above the tandem type image forming section 20 as shown in FIG. 1. At the opposite side of the tandem type image forming section 20, a secondary transfer unit 22 as a secondary transfer unit is provided to sandwich the intermediate transfer belt 10 between the tandem type image forming section 20 and the secondary transfer unit 22. In the example shown in FIG. 1, the secondary transfer unit 22 is formed with a secondary transfer belt 24 as an endless belt that is wound around between two rollers 23.

The secondary transfer unit 22 is disposed such that it is pressed against the third supporting roller 16 via the intermediate transfer belt 10. Based on this, the secondary transfer unit 22 carries out a secondary transfer of an image from the intermediate transfer belt 10 onto a sheet (i.e., a transfer sheet, an OHP sheet or the like) S as an image holding unit (i.e., a transfer material). A fixing unit 25 that fixes the image transferred onto the sheet S is provided a position adjacent to the secondary transfer unit 22. This fixing unit 25 is structured by having a pressing roller 27 pressed against a fixing roller (or a fixing belt) 26 as a fixing member.

The secondary transfer unit 22 also has a sheet conveying function of conveying the image-transferred sheet S to the fixing unit 25. A transfer roller or a non-contact charger may also be disposed as the secondary transfer unit 22. In this case, it becomes difficult to have the sheet conveying function. In the example shown in FIG. 1, a sheet inverter 28 that inverts the sheet S to record images onto both sides of the sheet S is provided below the secondary transfer unit 22 and the fixing unit 25, in parallel with the tandem type image forming section 20.

For operating the color copier to make a copy, the user sets a document on a document table 30 of the automatic document feeder (ADF) 400. Alternatively, the user opens the automatic document feeder (ADF) 400, sets the document on a contact glass 32 of the scanner 300, and closes the automatic document feeder 400 thereby to press the document. The user presses a starting button (not shown). When the document is set to the automatic document feeder 400, the automatic document feeder 400 conveys the document onto the contact glass 32, and then the apparatus drives the scanner 300.

When the document is set on the contact glass 32, the apparatus immediately drives the scanner 300. The apparatus runs a first traveling body 33 that is mounted with a light source and a mirror, and a second traveling body 34 that is mounted with two mirrors. The first traveling body 33 emits light from the light source, and reflects the light from the document surface with the mirror to the second traveling body 34. The second traveling body 34 further reflects this reflection light with the two mirrors into a reading sensor 36 (i.e., a color imaging device such as a color charge-coupled device (CCD)) through an image forming lens 35, thereby to read contents of the document.

The individual image forming units 18Y, 18M, 18C, and 18B rotate their corresponding photoreceptor drums 40Y, 40M, 40C, and 40B. The charging units 60Y, 60M, 60C, and 60B uniformly charge the surfaces of the photoreceptor drums 40Y, 40M, 40C, and 40B along the rotation of the photoreceptor drums 40Y, 40M, 40C, and 40B. Based on the contents read by the scanner 300, a semiconductor laser diode (LD) or a light emitting diode (LED) of the exposing unit 21 emits writing light L of each color onto the photoreceptor drums 40Y, 40M, 40C, and 40B. Based on this, the exposing unit 21 forms electrostatic latent images of the corresponding colors on the photoreceptor drums 40Y, 40M, 40C, and 40B. The developing units 61Y, 61M, 61C, and 61B develop the electrostatic latent images on the photoreceptor drums 40Y, 40M, 40C, and 40B using the developers carried on developing rollers 65Y, 65M, 65*c*, and 65B of the developing units 61Y, 61M, 61C, and 61B, respectively. The developing rollers 65Y, 65M, 65*c*, and 65B adhere corresponding toners to the electrostatic latent images, thereby to make the electrostatic latent images visible. Consequently, the developing units 61Y, 61M, 61C, and 61B form single-color images of yellow, magenta, cyan, and black respectively on the corresponding photoreceptor drums 40Y, 40M, 40C, and 40B.

By matching the timing with the image forming operation, a driving motor not shown drives one of the supporting rollers 14, 15, and 16, thereby to rotate the rest of the two supporting rollers, and the rollers convey the intermediate transfer belt 10. Following the rotational conveyance of the intermediate transfer belt 10, the primary transfer units (for example, transfer rollers or transfer chargers) 62Y, 62M, 62C, and 62B sequentially transfer the visible images from the photoreceptor drums 40Y, 40M, 40C, and 40B onto the intermediate transfer belt 10. Based on this, a combined color image of the four colors is formed on the intermediate transfer belt 10.

The photoreceptor cleaning units 63Y, 63M, 63C, and 63B remove the residual toners on the surfaces of the photoreceptor drums 40Y, 40M, 40C, and 40B after the transfer of the images, thereby to clean the photoreceptor drums. The decharging units 64Y, 64M, 64C, and 64B then remove the remaining charges from the photoreceptor drums 40Y, 40M, 40C, and 40B, thereby to prepare for the next image formation.

On the other hand, when the user presses a start switch not shown, the apparatus selectively rotates one of paper feeding rollers 42 on the paper feeding table 200, and takes out a transfer sheet S from one of multi-stage paper feeding cassettes 44 provided in a paper bank 43. A separation roller 45 separates each one of the sheets, and enters each sheet into a paper feeding path 46. A conveyor roller 48 conveys each sheet to guide the sheet into a paper feeding path 48 within the copier body 100, and stops the feeding of the sheet by butting the sheet against registration rollers 49. The apparatus rotates a paper feeding roller 50 to take out a sheet S from a manual paper feeding tray 51. A separation roller 52 separates each one of the sheets, enters each sheet into a manual paper feeding path 53, and stops the feeding of the sheet by butting the sheet against the registration rollers 49.

The apparatus rotates the registration rollers 49 to match the timing with the combined color image on the intermediate transfer belt 10, and feeds the sheet S into between the intermediate transfer belt 10 and the secondary transfer unit 22. Based on this, the combined color image is transferred onto the sheet S by the secondary transfer unit 22 thereby to record this image on the sheet S. The secondary transfer belt 24 of the secondary transfer unit 22 conveys the sheet S after the image transfer to the fixing unit 25.

The fixing unit 25 applies heat and pressure to the image-transferred sheet S to fix the transferred image. A switching claw 55 switches the sheet S to be guided to a discharge roller 56 where the discharge roller 56 discharges the sheet S to be stacked on a paper discharge tray 57. For copying images on both sides of each sheet S, the switching claw 55 is used to switch the sheet S to enter the sheet S into the sheet inverter 28. The sheet inverter 28 inverts the sheet S, and guides the sheet S to the transfer position again. The apparatus records an image onto the other side of the sheet S through an image formation process similar to the above.

After the image formation, the discharge roller 56 discharges the sheet S to be stacked on the paper discharge tray 57. On the other hand, the intermediate transfer unit cleaning unit 17 removes the residual toners on the intermediate transfer belt 10 after the image transfer, thereby to prepare for the next image formation.

The photoreceptor cleaning units 63Y, 63M, 63C, and 63B have cleaning blades 75Y, 75M, 75C, and 75B made of polyurethane rubber, for example, of which front ends are pressed against the photoreceptor drums 40Y, 40M, 40C, and 40B respectively. In order to improve the cleaning performance, brushes of which outer peripheries are brought into contact with the photoreceptor drums 40Y, 40M, 40C, and 40B are used. In the present embodiment, conductive fur brushes 76Y, 76M, 76C, and 76B of which outer peripheries are brought into contact with the photoreceptor drums 40Y, 40M, 40C, and 40B, are provided rotatably in the directions of arrows.

When the fur brushes 76Y, 76M, 76C, and 76B are rotated in directions opposite to the rotation directions of the photoreceptor drums 40Y, 40M, 40C, and 40B, these fur brushes remove the residual toners on the photoreceptor drums 40Y, 40M, 40C, and 40B respectively. A toner conveyor 80 that connects between each of the photoreceptor cleaning units 63Y, 63M, 63C, and 63B and each of the developing units 61Y, 61M, 61C, and 61B respectively returns the removed toner of each color to the corresponding developing unit, thereby to prepare for the next development.

The structural example of the color image forming apparatus according to the present invention has been explained above. In the present invention, the color image forming apparatus having the structure has the controller that controls the operation of each section of the image forming apparatus. The controller executes a self-diagnosis mode operation based on an interruption signal, in addition to a normal process control and an automatic adjustment. This self-diagnosis mode is a mode of diagnosing the image forming apparatus including a detection of a color mixed state of toners within the developing units.

Specifically, the controller not shown is formed with a central processing unit (CPU) including a microcomputer, memories such as read only memories (ROMs) and random access memories (RAMs), input and output units, control circuits of units in the image forming apparatus, a clock, and a timer. The controller controls each unit of the apparatus according to control programs stored in the memories, input information through the operation panel, and detection signals from various sensors, thereby to execute the control of the image forming operation and the self-diagnosis mode operation.

For example, when the user recognizes that the quality of an image is degraded, the user operates the self-diagnosis mode operation switch on the operation panel. Based on this, the controller first adjusts the process, and checks causes other than color mixture. When color mixture is the cause of the image quality degradation, the controller discharges toners from the developing units, and supplies new toners, thereby to refresh the operation.

In recycling the residual toners on the photoreceptor drums 40Y, 40M, 40C, and 40B in the color copier having the structure shown in FIG. 1 and FIG. 2, there is a problem of the occurrence of color mixture in the toners of a second color and afterwards. For example, after a yellow toner image as a first color is primarily transferred from the photoreceptor drum 40Y onto the intermediate transfer belt 10, other colors of other toners are not mixed into the residual toner on the photoreceptor drum 40Y. Therefore, regarding the residual toner of the first color, it is possible to use the recovered toner straight again as a recycling toner.

However, after the primary transfer of the toner images of the second and subsequent colors is sequentially carried out from the photoreceptor drums 40Y, 40M, 40C, and 40B onto the intermediate transfer belt 10, colors of other toners may be mixed into the residual toners on the photoreceptor drums. In other words, when the toner images of the second and subsequent colors are primarily transferred onto the intermediate transfer belt 10, the toner images having been transferred onto the intermediate transfer belt 10 at the upstream already exist on this intermediate transfer belt 10.

Therefore, these toner images are reversibly transferred onto the surfaces of the photoreceptor drums 40Y, 40M, 40C, and 40B, and the colors of these reversibly transferred images are mixed with the toners on the photoreceptor drums. Consequently, regarding the toners of the colors of the second color and afterwards that remain on the photoreceptor drums, it is not possible to reutilize the recovered toners straight as recycling toners.

For example, when the second color magenta toner image is to be primarily transferred from the photoreceptor drum 40M onto the intermediate transfer belt 10, the intermediate transfer belt 10 already carrying thereon the yellow toner image as the first color primarily transferred enters into a primary transfer nip. The magenta toner image is primarily transferred onto the intermediate transfer belt 10 at the nip between the photoreceptor drum 40M and the intermediate transfer belt 10. At the same time, the yellow toner that forms the yellow toner image on the intermediate transfer belt 10 is reversibly transferred onto the photoreceptor drum 40M.

Consequently, the photoreceptor cleaning unit 63M of the photoreceptor drum 40M recovers the residual toner in the state that the residual magenta toner after the image transfer and the yellow reversibly transferred toner are mixed together. This phenomenon is the color mixture. The case in which the toner of the mixed colors is supplied straight to the developing unit 61M and is used again gives small influence to the image quality if there is a small quantity of the color mixture. However, if there is a large quantity of the color mixture, the hue changes. In other words, a color difference becomes large, which lowers the color reproducibility.

Figure 3:
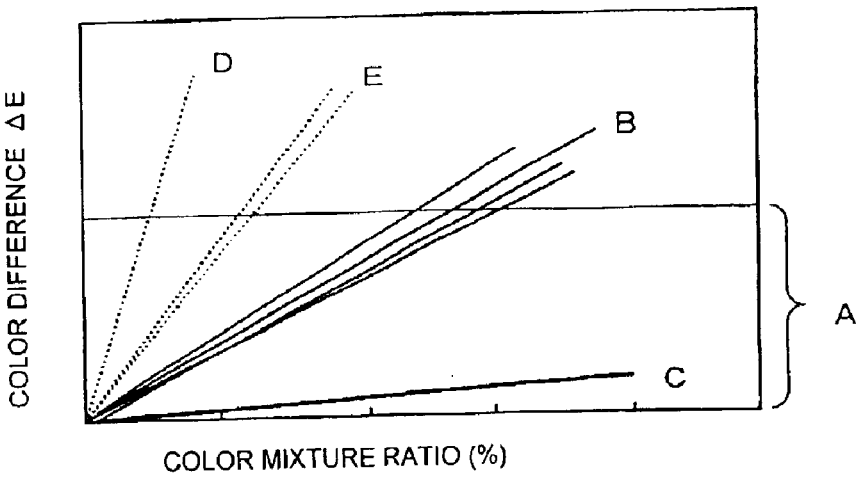
FIG. 3 is a graph of a result of measuring a difference (i.e., a color difference) ÄE between an original color and a color when a color mixture level is changed.

The change of the hue due to the color mixture is different depending on a combination of mixed colors as well as a color mixture level (hereinafter referred to as a color mixture ratio). FIG. 3 is a graph of a result of measuring a difference (hereinafter referred to as a color difference) ÄE between an original color and a color when the color mixture level is changed. Assume that a permissible value of the color difference ÄE is expressed as A. An image may be prepared based on a condition that the color mixture is within a range of the permissible value A.

A marginal color mixture ratio of each color is expressed as an X coordinate of an intersection point between a line A and each line of a color mixture. A line C in the graph indicates a mixture of black in each color toner. A line D indicates a mixture of black in the yellow toner. A group of lines E indicates a mixture of black in the cyan toner and a mixture of black in the magenta toner. A group of lines B indicates other combinations of color toners. A marginal color mixture ratio is obtained from this graph, and an image is output based on the following condition. That is, yellow that has a smallest total value of marginal color mixture ratios when other three colors are mixed into the color is set as a first color. Black that has a largest total value of marginal color mixture ratios is set as a fourth color. Magenta is set as a second color, and cyan is set as a third color. A full-color image is printed based on the assumption that a marginal color mixture ratio of yellow into magenta is 6%, a marginal color mixture ratio of magenta into cyan is 7%, and a marginal color mixture ratio of black into cyan is 40%. As a result, it is possible to obtain a satisfactory image.

The image is formed based on the following process and conditions. A non-image portion of each of the photoreceptor drums 40Y, 40M, 40C, and 40B is charged at a voltage of −700 volt according to a non-contact roller charging system. A laser diode is used to expose the portion, and the developing units 61Y, 61M, 61C, and 61B are used to form toner images of corresponding colors. The developed toner images on the photoreceptor drums are primarily transferred to the intermediate transfer belt 10. In the experiment this time, the intermediate transfer belt 10 has a surface elastic layer provided on a resin layer, which has volume resistivity of $8\times10^{9}$ ohm-cm.

The primary transfer bias of 1300 volts is applied based on constant voltage control. It is needless to mention that the bias value changes depending on a belt material. The photoreceptor cleaning units 63Y, 63M, 63C, and 63B of a blade system are used to recover the residual toners on the photoreceptor drums 40Y, 40M, 40C, and 40B by bringing the front ends of the blades into contact with the photoreceptor drums 40Y, 40M, 40C, and 40B.

Figure 4:
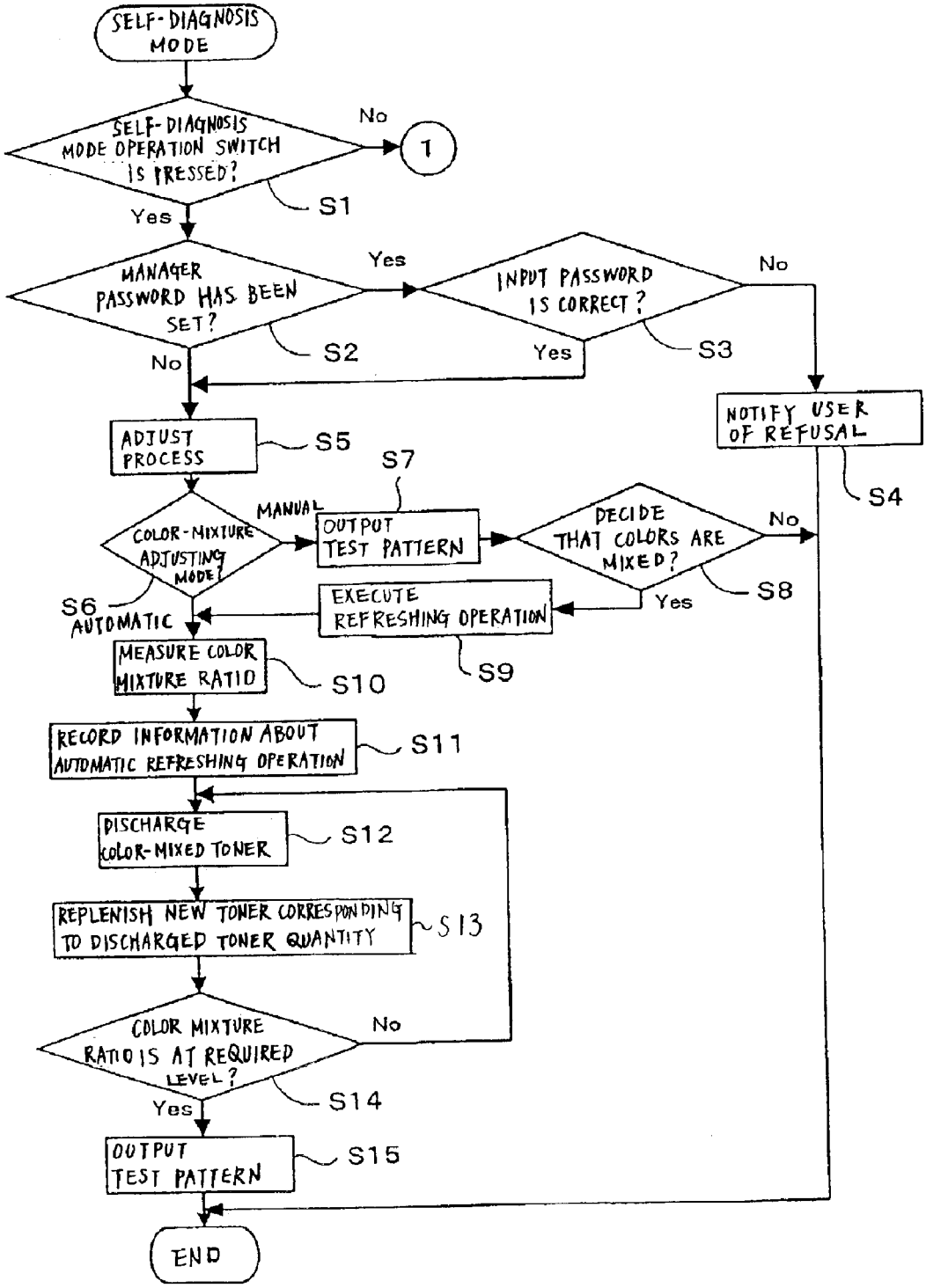
FIG. 4 is a flowchart of one example of a control operation in a self-diagnosis mode.
Figure 5:
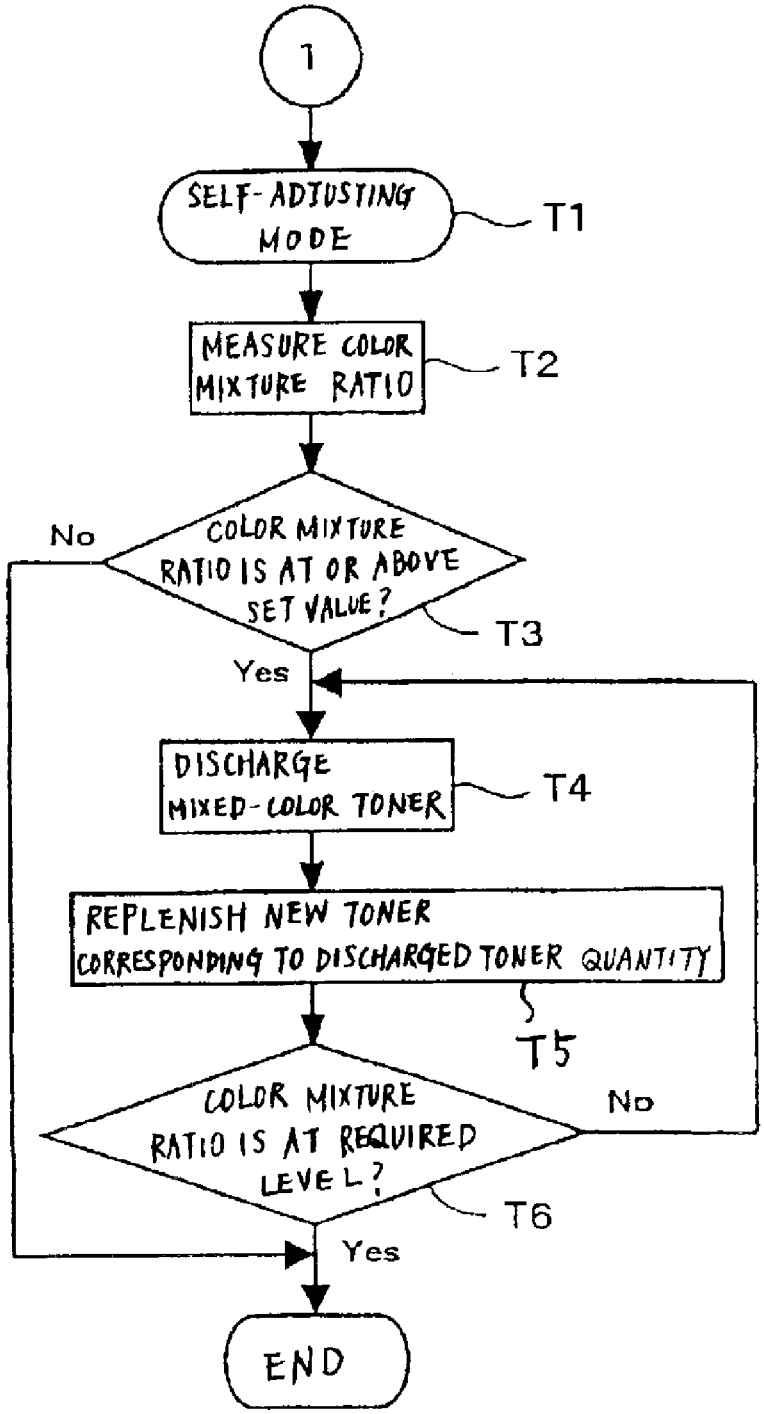
FIG. 5 is a flowchart of one example of a control operation in a self-adjusting mode when an operation switch for the self-diagnosis mode is not pressed.

The control operation in the self-diagnosis mode of the color image forming apparatus according to the present invention will be explained next. FIG. 4 is a flowchart of one example of the control operation in the self-diagnosis mode. FIG. 5 is a flowchart of one example of the control operation in a self-adjusting mode that is executed when an operation switch of the self-diagnosis mode is not pressed (i.e., during the normal operation) at step 1 (S1) in FIG. 4.

In the control operation shown in FIG. 4, when the self-diagnosis mode operation switch is not pressed (during the normal operation) at step S1, the automatic adjusting mode (T1) is automatically executed at every predetermined period, and a color mixture ratio of each color is measured (T2). It is decided whether the measured color mixture ratio for each color is at least a preset value (for example, the marginal color mixture ratio) (T3). When the color mixture ratio is at least the preset value, each developing unit of each color is refreshed. In other words, the color-mixed toners are discharged (T4), and each developing unit is replenished with new toners corresponding to the quantities of the discharged toners (T5). The replenishment is automatically adjusted until the color mixture ratios become the requested levels (T6). However, based on only the automatic adjustment of the color mixture ratios, the hue of the image may be degraded to such an extent that the user cannot accept it, depending on changes in the process conditions of the image forming apparatus.

As explained above, when the hue of the output image is degraded to such an extent that the user cannot accept it, the user can always use the self-diagnosis mode operation switch. Therefore, the user can operate the switch to control the hue without carrying out a plurality of operations. When a plurality of unlimited number of users use the apparatus, a manager can manage the operation by using a password, thereby to limit a user who can use the self-diagnosis mode operation switch.

In the example of the control operation shown in FIG. 4, when a manager password has been set (S2), even if the self-diagnosis mode operation switch is pressed (S1), it is decided whether the input password is correct (S3). When the password is not correct, the apparatus refuses the execution of the self-diagnosis mode operation, and notifies the user of the refusal (S4). When the password is correct or when the manager password is not set, the controller executes the self-diagnosis mode operation (S2, and S3). Based on the execution of the self-diagnosis mode operation, the controller first adjusts the process (S5).

In the present invention, when it is decided that the hue of the obtained image is abnormal because the hue exceeds a user's decision standard, the user instructs the recovery of the color reproducibility (by pressing the self-diagnosis mode operation switch). The hue may be different from what the user wants due to a change in the machine processing condition or a change in the image data processing, as well as the hue becomes different due to actual mixture of colors. Therefore, when the controller receives the instruction to execute the self-diagnosis mode operation from the user, the controller must discriminate between the causes to identify whether the hue difference occurs due to color mixture or due to a change in the machine condition. In other words, the refreshing of toners means consumption of valuable toners and discharging of the toners to the outside, this involves an important cost issue.

In the color copier, the causes of the occurrence of a change in the hue are broadly classified into the followings.

(i) Change in a hue of a basic color for process.

(a) A absorption spectrum of toner changes due to color mixture.

(b) A reflection spectrum of paper as a basis is different.

(c) A toner adhesion quantity changes, which makes a reflection density different.

(d) A fixing temperature is different, which makes a reflection density and gloss different.

(ii) Change in a mixture ratio of a secondary color.

(a) A toner adhesion quantity on a photoreceptor drum is different.

(b) A transfer rate and a reverse transfer rate for each process color are different.

(c) An $\tilde{a}$ value is different for each process color, and halftones do not match.

(d) A mixture of an unnecessary color due to stain on a surface.

(e) A mixture of an unnecessary color due to an abnormality in the image processing.

(iii) A different coloring due to a deviation of color registration.

As explained above, the hue changes due to the color mixture as a direct cause only in (i) (a). In other cases, there is no effect of avoiding the hue change even when the toners in the developing units are refreshed. Therefore, it is preferable to first diagnose whether the color mixture is the problem.

It is most certain to print a single color of a process color on paper based on a process condition of a prescribed density, and ask the user to decide on this. Alternatively, the hue of the process color is automatically confirmed.

Therefore, it is necessary to carry out self-diagnosis within the apparatus condition to print the process color in a state that there is no disturbance other than the color mixture as far as possible.

Usually, the image forming apparatus has a process adjusting mechanism for automatically adjusting the process when the power supply is turned on, or after the apparatus prints a large quantity of paper (such as about 100 sheets), or when the apparatus does not carry out a printing for some time (for example, six hours after the last printing). When the apparatus receives a refreshing instruction from the user, the apparatus should also adjust the process as there is a possibility of an error in the machine condition such as the process other than color mixture.

Figure 7:
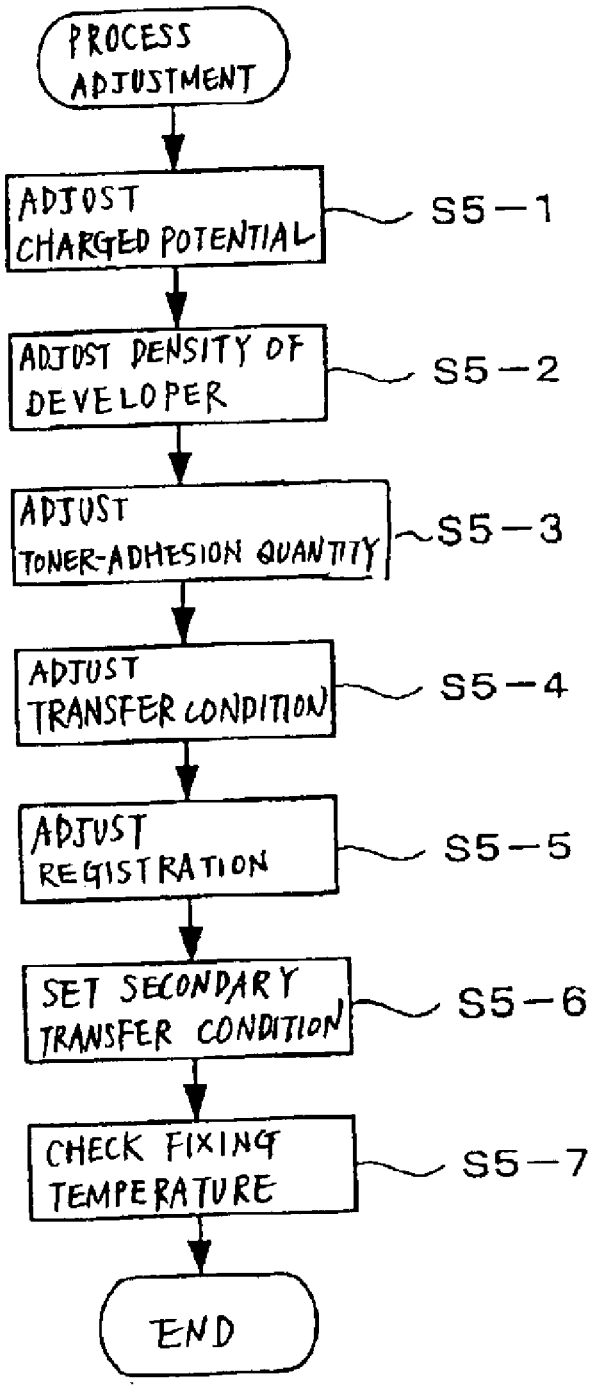
FIG. 7 is a flowchart of one example of a control operation for process adjustment.

FIG. 7 is a flowchart of the process adjustment (S5). The outline processing is as follows. It is noted that when a machine does not have a corresponding sensor, the adjustment is skipped, or an alternative device carries out a similar adjustment.

At S5-1: Adjustment of a Charged Potential

A surface potential sensor (i.e., a V sensor) provided on each photoreceptor drum is used to carry out this adjustment. First, the potential of the tube of the photoreceptor drum is changed to four levels of 0 volt, −250 volt, −500 volt, and −750 volt, thereby to calibrate the V sensor. After the calibration, the potential is returned to the normal ground voltage (0 volt). The charging unit charges the photoreceptor drum without carrying out exposure. The V sensor checks whether the potential of the charged surface of the photoreceptor drum is at the set value. When the surface potential is deviated from the set value, the charged current or voltage is controlled to adjust the surface potential to the set value.

At S5-2: Adjustment of Density of a Developer

A toner density sensor (i.e., a magnetic sensor (a T sensor)) that is provided in the developing unit that uses a two-component developer is used to adjust the density of the developer. When the density of the developer is low, a toner is replenished. When the density of the developer is high, in some cases, the developing unit carries out a development on the photoreceptor drum by using a constant quantity of the developer thereby to discharge the toner. However, when the density of the developer is high, usually, the quantity of the developer is adjusted based on a developing bias, and the adjustment is not carried out in many cases. In the present invention, this adjustment is not carried out because a refreshing operation is carried out afterward.

At S5-3: Adjustment of a Toner Adhesion Quantity

An exposing unit such as a laser diode or a light-emitting diode is used to change a quantity of light exposure (usually about 8 to 16 gradations), and emit the light to the photoreceptor drum. The V sensor is used to previously detect the potential of the photoreceptor drum at this time. The developing unit develops this latent image in a state that a predetermined developing bias is set. A quantity of the toner that is adhered to the photoreceptor drum is detected based on a reflection output from an optical sensor (i.e., a P sensor). The developing bias is determined based on the adhesion quantity for each of the obtained gradations so that the adhesion quantity becomes a maximum toner adhesion quantity on the photoreceptor drum. At the same time, the writing power of the exposing unit such as the laser diode is set so that the gradation becomes linear. This operation is carried out for each process unit (i.e., for each station of each color).

At S5-4: Adjustment of a Transfer Condition

When the apparatus has the P sensor in front of the cleaning position after the image transfer onto the photoreceptor drum, the transfer bias is adjusted, thereby to optimize the setting of the primary transfer bias. The density of the residual toner on the photoreceptor drum after the transfer of the sensor pattern in the prescribed transfer bias is measured. The transfer bias is adjusted so that the density becomes a minimum value.

At S5-5: Adjustment of Registration

Images are matched at each station. At each station, a registration pattern is transferred onto the intermediate transfer belt or the sheet conveyor transfer belt. An optical sensor provided on the belt reads the sensor pattern, and the writing timing is adjusted so as to be in synchronization with the sensor pattern.

At S5-6: Setting of a Secondary Transfer Condition

When the intermediate transfer unit is used, the apparatus determines a secondary transfer current condition set according to the temperature and humidity measured in advance by a temperature and humidity sensor provided within the apparatus.

At S5-7: Checking of a Fixing Temperature

A thermistor or the like is used to check whether the temperature of the fixing roller (or the fixing belt) of the fixing unit is at a preset value.

After the adjustments of process conditions are carried out, the possibility of the occurrence of a change in the hue due to process and machine conditions must be substantially low. Thereafter, when the refreshing (i.e., the color mixture adjusting mode (S6)) is carried out automatically, the color mixture ratio is checked (S10). When decision is left to the user, a single-color check sheet of the process color is output (S7).

When decision is left to the user, the user makes the decision based on the check sheet (S8). When the color mixture is observed, the user generates an interruption signal, thereby to carry out the refreshing operation (S9).

When the refreshing operation is carried out automatically, the apparatus checks the color mixture ratio (S10). For checking the state of color mixture, a reflection spectrum sensor can easily measure the reflection spectrum of the toner that is developed on the photoreceptor drum, which has little disturbance. Because of a mechanical structure or for cost reason, it is also possible to observe the reflection spectrum on the intermediate transfer belt or the paper transfer conveyor belt. However, in this case, there is a risk of a large disturbance due to the surface stained by other stations or the stain of the belt itself, which requires attention.

It is possible to realize the reflection spectrum sensor based on a combination of light sources that can individually emit three primary colors of light including red (R), green (G), and blue (B), and a light-receiving sensor that can measure the intensity of the light reflected from the toner image. It is also possible to obtain light sources of the three primary colors of light by separating the white light source with three kinds of complementary color filters or a prism. It is also possible to use a light source (LED or LD) that has a light emission wavelength that is originally determined. It is also possible to use a white light source for the light source itself, and use a prism, a grating, and a filter at the light receiving side thereby to carry out a spectrum analysis of the received light. By using these sensors, it is possible to determine the hue based on the ratio of the reflectance of the three primary colors R, G, and B. Therefore, it is possible to decide the color mixture level depending on to what degree the reflectance ratio is different from the reference value.

When the color mixture ratio is measured, the apparatus records the information about the refreshing operation that the user carried out (S11). The information to be recorded includes a color mixture ratio at the point of time when the refreshing operation is started, and a number of times when the refreshing operation switch is operated. Based on this record information, the apparatus determines a start of the next automatic refreshing operation in the automatic setting mode. With this arrangement, it becomes possible to automatically carry out the refreshing operation including the control operation as shown in FIG. 5, without requiring the user to operate the refreshing operation switch. When a difference occurs between the user's request and the operation in the automatic setting mode, the user can set again the automatic setting mode.

When a service person visits each user, the record information can be read from the storage device such as a memory. When apparatuses are connected to the service center via the network, it is possible to collectively manage a large number of image forming apparatuses.

The color-mixed toner is discharged as an output of a solid image (S12). It is possible to manage the toner discharging quantity based on the number of sheets of solid images. Assume that each sheet of paper used is A4 in size, that the size of the solid image on the paper is 210×297 $mm^2$, and that the toner adhesion quantity per unit area M/A is 0.6 $mg/cm^2$. Then, the quantity of the toner used per output sheet of solid image becomes 374 milligrams. It is possible to manage the toner discharging quantity by changing the toner adhesion quantity per unit area M/A. For example, assume that the developer within the developing unit has a weight of 700 grams, the toner included in the developer has a weight of 60 grams, and the color mixture ratio is 10%. Then, it is possible to lower the color mixture ratio by 0.06% per output sheet of a solid image.

It is also possible to discharge the color-mixed toner when the intermediate transfer unit cleaning unit 17 forms a solid image on the intermediate transfer belt 10 for a constant period of time. For example, assume that the toner adhesion quantity per unit area M/A is 0.6 $mg/cm^2$, that the linear velocity of the intermediate transfer belt 10 is 200 mm/sec, that the width of the image formed is 297 millimeters, and that the color mixture ratio is 10%. Then, the toner discharge quantity per second becomes 360 milligrams. When the quantity of the toner within the developing unit is 60 grams, it is possible to lower the color mixture ratio by 0.6% per second.

When the direct transfer system is employed, it is also possible to discharge the color-mixed toner when the cleaning unit of the transfer conveyor belt is operated to recover the solid images formed on the transfer conveyor belt.

A new toner is replenished after the toner of the set discharging quantity of the color-mixed toner has been discharged completely. The new replenished toner is stirred until a sufficient charge quantity of the toner is obtained (S13, and S14).

When a refreshing operation other than the automatic refreshing operation is ended, it is possible to form a test-pattern image for checking a color mixture, and output this image (S15). By actually checking the output test pattern, the user can easily visually confirm whether the color-mixed toner has been refreshed. The output test pattern is a solid image of each color of the toner within the developing unit of the second color and afterwards. Output a test-pattern image can be also set before carrying out the refreshing operation. When comparing the test-pattern image after the refreshing operation with the test-pattern image before the refreshing operation, the user can more securely visually confirm that the toner has been refreshed.

It is possible to output the test-pattern image before the refreshing operation, by type of toner for each developing unit. Therefore, it is possible to carry out the refreshing operation to only the developing unit that has the color-mixed toner.

In the initial state when the apparatus is shipped, the refreshing operation automatic setting unit is off. With this arrangement, the user carries out the first operation of the setting, which allows the user to recognize the function of the refreshing operating unit and to make positive use of the apparatus. By keeping record of a color mixture ratio of each color in each developing unit at this time, the apparatus can set information for the color mixture ratio based on this information when the user sets the apparatus to the automatic setting mode.

Figure 6:
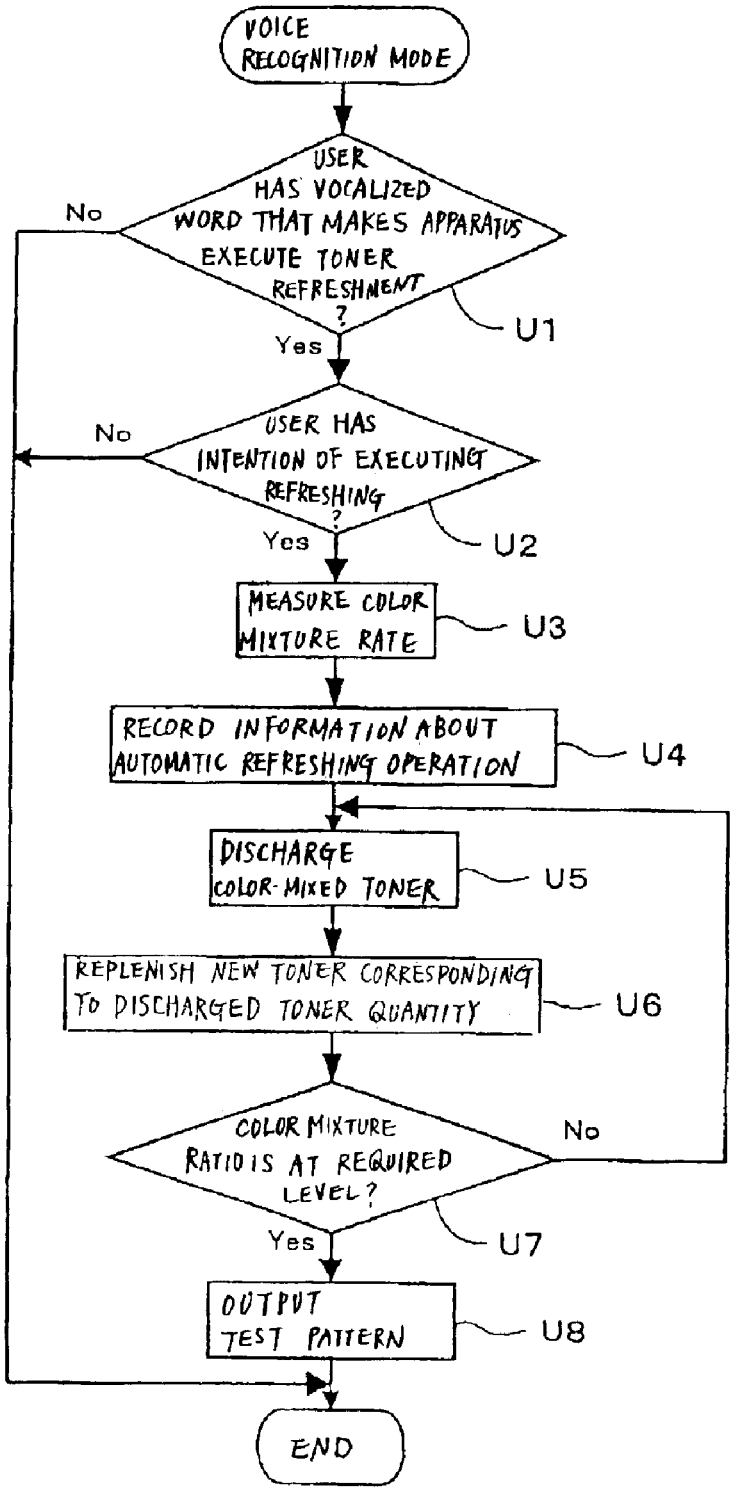
FIG. 6 is a flowchart of one example of a control operation in a voice recognition mode.

It is also possible to generate the interruption signal for executing the self-diagnosis mode based on voice input in addition to the manual input operation on the operation panel. FIG. 6 is a flowchart of one example of the control operation in the voice recognition mode in which the interruption signal is generated based on voice input thereby to execute the refreshing operation.

When the voice recognition mode in which the voice recognizer operates is on, the user vocalizes a word that is registered in advance as shown in the control operation of FIG. 6. When the voice recognizer recognizes this word, the apparatus starts the refreshing operation (U1). However, when the user happens to vocalize the registered word while the user is talking with a third person or talking near the image forming apparatus, the voice recognizer may recognize this word as a switch. To overcome this situation, the apparatus can ask the user whether the user has the intention of executing the refreshing operation (U2). In this case, the image forming apparatus can ask the user in voice for confirmation, and the user can give the instruction in voice.

In this voice recognition mode, the apparatus also measures the color mixture ratio (U3). In the automatic adjusting mode in which the refreshing operation automatic setting unit operates, the apparatus sets record information as an initial state (U4). The apparatus measures the color mixture ratio at every constant time or for each constant number of sheets. When there is a plurality of developing units, the apparatus executes the refreshing operation when all the color mixture ratios of the developing units having color-mixed toners exceed preset values (U5 to U7). The apparatus records the record information and takes statistics at the same time, each time when the user operates the refreshing operation switch, thereby to update the automatic setting value each time.

When the refreshing operation is ended, the apparatus forms an image of a test pattern for recognizing the color mixture, and outputs the test-pattern image (U8). By actually checking the test-pattern image, the user can visually confirm whether the color-mixed toner has been refreshed.

As explained above, the image forming apparatus according to the present invention executes the self-diagnosis mode when the user requests this mode. By performing diagnoses on the image forming apparatus including the detection of the color mixed state of the toner within each developing unit, it becomes possible to efficiently recover the color reproducibility. As a result, according to the present invention, it is possible to satisfy marginal color mixture permissible values for a wide range of users. Thus, it is possible to avoid wasteful discharging of toners.

As explained above, in the image forming apparatus according to the present invention, diagnosis is carried out to the image forming apparatus in the self-diagnosis mode including the detection of a state of color mixture in a toner within each developing unit. Therefore, it becomes possible to efficiently recover color reproducibility.

Moreover, in the image forming apparatus, by detecting a state of color mixture in a toner within each developing unit in the self-diagnosis mode, it is also possible to determine whether a refreshing operation is needed.

Furthermore, in the image forming apparatus, an interruption signal is generated based on a user's operation on the operation panel. Therefore, the user can operate the apparatus easily without requiring a complex operation.

Moreover, in the image forming apparatus, an interruption signal is generated based on voice input. Therefore, the self-diagnosis mode can be executed without requiring the operation on the operation panel.

Furthermore, in the image forming apparatus, parameters within the image forming apparatus are corrected to overcome a specified cause of a color mixture, according to a result of the self-diagnosis mode operation. Therefore, it is possible to automatically recover color reproducibility.

Furthermore, in the image forming apparatus, if the color mixture is at a specific level or higher as a result of detecting the state of color mixture of toners within the developing unit, the controller of the image forming apparatus executes the partial toner replacement mode in which the toner in the developing unit is partially replaced with new toner. Therefore, it is possible to refresh toners.

Moreover, in the image forming apparatus, by detecting a surface potential, it becomes possible to diagnose whether the color mixture is abnormal.

Furthermore, in the image forming apparatus, by detecting density of a developer, it becomes possible to diagnose whether the color mixture is abnormal.

Moreover, in the image forming apparatus, by detecting a toner image adhesion quantity or reflection density of the toner image, it becomes possible to diagnose whether the color mixture is abnormal.

Furthermore, in the image forming apparatus, by detecting a transfer bias, it becomes possible to diagnose whether the color mixture is abnormal.

Moreover, in the image forming apparatus, by detecting a sensor pattern for image registration, it becomes possible to diagnose whether the color mixture is abnormal.

Furthermore, in the image forming apparatus, by detecting a secondary transfer bias, it becomes possible to diagnose whether the color mixture is abnormal.

Moreover, in the image forming apparatus, by detecting a temperature of the fixing roller of the fixing unit, it becomes possible to diagnose whether the color mixture is abnormal.

Furthermore, in the image forming apparatus, by outputting a test pattern for checking a color mixture before the state of color mixture of the toner within the developing unit is executed, the user can decide about presence or absence of a color mixture.

Moreover, in the image forming apparatus, by outputting a test pattern for checking a color mixture by type of toner within each developing unit, and by executing the refreshing operation to only a developing unit that has a mixed-color toner, it is possible to reduce wasteful discharging of toners.

Furthermore, in the image forming apparatus, when a preset time lapses or when a toner color mixture ratio is lowered to a preset value or less, the refreshing operation is ended. Therefore, it is possible to refresh the toners that have color mixture in the developing unit without wastefully consuming the toners.

Moreover, in the image forming apparatus, when the refreshing operation is ended, an image is formed with a test-pattern image for confirming a color mixture, and the user directly visually checks the color mixture level. Therefore, the user can confirm to what degree the mixed toner has been refreshed through the operation by the user.

Furthermore, the image forming apparatus is provided with the automatic refreshing operating setting unit that maintains record information about the user's operation of the refreshing operating unit, and that adjusts both the starting timing of the next automatic refreshing operation and/or the ending timing of the next automatic refreshing operation based on the record information. Therefore, the apparatus can automatically set refreshing intervals to match the intervals with the user's using frequency, and the user can utilize the refreshing operation automatic setting unit without requiring a complex setting.

The present document incorporates by reference the entire contents of Japanese priority document, 2002-171421 filed in Japan on Jun. 12, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller operates an automatic self-adjusting mode when an interruption signal is not present and starts a self-diagnosis mode when the interruption signal is present, and diagnosis is performed on the image forming apparatus in the self-diagnosis mode, wherein the diagnosis includes detecting how colors of toners are mixed within each of the developing units.

2. The image forming apparatus according to claim 1, wherein the self-diagnosis mode includes a plurality of steps, and at least at a second step and afterwards, it is detected how the colors of the toners are mixed within the developing unit.

3. The image forming apparatus according to claim 1, wherein the interruption signal is generated based on an operation by a user on an operation panel.

4. The image forming apparatus according to claim 1, wherein the controller corrects parameters in the image forming apparatus so as to overcome a specified cause of a color mixture, according to a result of operation in the self-diagnosis mode.

5. The image forming apparatus according to claim 1, wherein the controller executes a partial replacement mode in which a part of the tapers in the developing units is replaced when the color mixture reaches at least a specific level as a result of detecting the color mixture of toners within each of the developing unit.

6. The image forming apparatus according to claim 1, wherein in the self-diagnosis mode, density of a developer in the developing unit is detected.

7. The image forming apparatus according to claim 1, wherein in the self-diagnosis mode, either one of toner adhesion quantity of a toner image and reflection density of the toner image is detected, the toner image being formed on either one of the image carrier and the image transfer medium.

8. The image forming apparatus according to claim 1, wherein in the self-diagnosis mode, a test pattern for checking a color mixture is output before detection of the color mixture of toners within the developing unit is conducted.

9. The image forming apparatus according to claim 8, wherein the test pattern for checking a color mixture is output by each type of toner in each of the developing units, and a refreshing operation is performed only on a developing unit that has a mixed-color toner, wherein the refreshing operation is such that the toner is discharged from the developing unit and a new toner is supplied to the developing unit.

10. The image forming apparatus according to claim 9, wherein the refreshing operation is ended in either one of a case in which a preset time lapses and a case in which a color mixture ratio of toners is lowered to a preset value or less.

11. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interrupting signal, and diagnosis is performed on the image forming apparatus in the self-diagnosis mode, wherein the diagnosis includes detecting how colors of toners are mixed within each of the developing units, wherein the interruption signal is generated based on voice input.

12. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interrupting signal, and diagnosis is performed on the image forming apparatus in the self-diagnosis mode, wherein the diagnosis includes detecting how colors of tuners are mixed within each of the developing units, wherein in the self-diagnosis mode, a surface potential of each of the image carriers is detected, the detection being performed on the image carrier after any one of charging, exposure, developing, transfer, and cleaning.

13. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interruption signal, and diagnosis is performed on the image forming apparatus in the self-diagnosis mode, wherein the diagnosis includes detecting how colors of toners are mixed within each of the developing units, wherein in the self-diagnosis mode, a transfer bias is detected.

14. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interruption signal, and diagnosis is performed on the image forming apparatus in the self-diagnosis mode, wherein the diagnosis includes detecting how colors of toners are mixed within each of the developing units, wherein in the self-diagnosis mode, a sensor pattern for image registration is detected.

15. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interruption signal, and diagnosis is performed on the image forming apparatus in the self-diagnosis mode, wherein the diagnosis includes detecting how colors of toners are mixed within each of the developing units, wherein in the self-diagnosis mode, a secondary transfer bias is detected.

16. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interruption signal, and diagnosis is performed on the image forming apparatus in the self-diagnosis mode, wherein the diagnosis includes detecting how colors of toners are mixed within each of the developing units, wherein in the self-diagnosis mode, a temperature of a fixing member of a fixing unit is detected.

17. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interruption signal, and diagnosis is performed on the image forming apparatus in the self-diagnosis mode, wherein the diagnosis includes detecting how colors of toners are mixed within each of the developing units, further comprising a unit that forms a test-pattern image for checking a color mixture when a refreshing operation is ended, wherein a user can visually confirm whether the image has been improved.

18. An image forming apparatus comprising:

a plurality of developing units that accommodate toners of different colors;

a plurality of image carriers on which toner images of the different colors are formed;

a transfer medium onto which the toner images are sequentially transferred from the image carriers, wherein toner remaining on each of the image carriers after image transfer is recovered, and the recovered toner is supplied to each of the developing units for reutilization of the recovered toner; and a controller that controls operation of the image forming apparatus, wherein the controller starts a self-diagnosis mode based on an interruption signal, and diagnosis is performed on the image forming apparatus in the self-diagnosis mode, wherein the diagnosis includes detecting how colors of toners are mixed within each of the developing units, further comprising:

a refreshing operation automatic setting unit that records record information for operations in an automatic adjusting mode performed by a user, and that adjusts at least one of a starting timing and an ending timing of a next automatic refreshing operation based on the record information.

* * * * *